US008991663B2

(12) United States Patent
Gisler

(10) Patent No.: US 8,991,663 B2
(45) Date of Patent: Mar. 31, 2015

(54) CASTING TUBE MOUNTING, IN PARTICULAR FOR A SLIDING CLOSURE

(75) Inventor: Rebecca Gisler, Hünenberg See (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 225 days.

(21) Appl. No.: 13/582,105

(22) PCT Filed: Mar. 1, 2011

(86) PCT No.: PCT/EP2011/000991

§ 371 (c)(1), (2), (4) Date: Sep. 12, 2012

(87) PCT Pub. No.: WO2011/107253

PCT Pub. Date: Sep. 9, 2011

(65) Prior Publication Data

US 2012/0325868 A1 Dec. 27, 2012

(30) Foreign Application Priority Data

Mar. 5, 2010 (CH) ..... 0295/10

(51) Int. Cl.
*B22D 41/56* (2006.01)
*B22D 41/50* (2006.01)

(52) U.S. Cl.
CPC ..... *B22D 41/56* (2013.01); *B22D 41/502* (2013.01)
USPC ..... 222/606

(58) Field of Classification Search
CPC .... B22D 41/56; B22D 41/26; B22D 17/2015; B22D 41/34; B22D 41/40; B22D 41/50; B22D 41/28; B22D 41/38; B22D 11/064; B22D 11/0642; B22D 41/502
USPC ..... 266/44, 45, 236; 222/606, 607, 591, 222/594; 164/335, 337, 457
See application file for complete search history.

(56) References Cited

U.S. PATENT DOCUMENTS

| | | | | |
|---|---|---|---|---|
| 4,402,437 | A | 9/1983 | Fortner et al. | |
| 6,755,235 | B1 * | 6/2004 | Nedic | 164/335 |
| 7,407,068 | B2 * | 8/2008 | Klingensmith et al. | 222/607 |

FOREIGN PATENT DOCUMENTS

| | | |
|---|---|---|
| EP | 0033309 B1 | 6/1983 |
| JP | 6154970 A | 6/1994 |
| JP | 9201657 A | 8/2007 |

* cited by examiner

*Primary Examiner* — Scott Kastler
*Assistant Examiner* — Michael Aboagye
(74) *Attorney, Agent, or Firm* — Brian Roffe

(57) ABSTRACT

Casting tube mounting including a centering device for the casting tube, a toothed centering crown and a centering ring having radial pins. When the casting tube is pressed on, the radial pins engage in tooth gaps of the centering crown and thus effect immovably precise centering and alignment of the casting tube.

20 Claims, 4 Drawing Sheets

CASTING TUBE MOUNTING, IN PARTICULAR FOR A SLIDING CLOSURE

FIELD OF THE INVENTION

The invention relates to a casting tube mounting, in particular for a sliding closure, for the casting of steel and similar molten metals, comprising a support ring and a centring device for the casting tube, the latter having two components that interact with one another, one of which is mounted in the support ring, while the other is fastened onto the sliding closure.

BACKGROUND OF THE INVENTION

Apparatuses of this type are used in particular for the casting of steel into a tundish or a similar container. By means of a manipulator acting on the support ring the casting tube is pressed against the pouring sleeve of the sliding closure. In this way a metal-tight connection is established between the two parts. At the same time both parts are centred axially relative to one another so that a casting channel passing through both parts in operation is produced.

With this type of casting tube mounting there is disposed in the support ring of the casting tube a resilient centring ring the conical centring surface of which interacts with a receiving bore hole in the sliding closure which is also conical. By means of the resilient arrangement any dimensional deviations of the fireproof parts or unevennesses in the receiving bore hole, for example due to splashes of metal or other contaminating items, are compensated. However, it is a disadvantage with the resilient arrangement that it does not always guarantee correct alignment of the casting tube.

OBJECTS AND SUMMARY OF THE INVENTION

The object underlying the invention is to provide a casting tube mounting of the type specified at the start of which the centring device operates functionally reliably during the rough casting operation and guarantees both perfect tightness and correct alignment of the casting tube.

This object is achieved according to the invention in that the centring device is formed by a toothed centring crown and a centring ring interacting with the latter with radial pins that can engage in the tooth gaps of the centring crown.

When the casting tube is pressed against the casting sleeve of the sliding closure the centring ring and the centring crown are automatically coupled to one another and thus bring about immovable centring and alignment of the casting tube for the duration of operation.

The device according to the invention is structurally robust and can be used with a small amount of maintenance. In addition, it is an advantage that the torques produced when the slide plate, and with it the shrouding tube, are moved, and are transferred from the liquid steel to the shrouding tube, are absorbed and equalised by the mechanism.

In a first embodiment the invention makes provision such that the centring crown is fastened to the sliding closure, while the centring ring is mounted in the support ring and can be pushed into the centring crown.

In contrast, in a second embodiment provision is made according to the invention such that the centring ring is fastened to the sliding closure, while the centring crown is mounted in the support ring and can be pushed into the centring ring.

In the first embodiment the centring crown remains easily accessible. In the second embodiment it is better protected by the centring ring. In both cases the device according to the invention brings about pre-centring of these parts before the radial pins of the centring ring engage in the tooth gaps of the centring crown and guarantee final centring and alignment of the casting tube.

It is useful within the context of reliable centring and alignment of the casting tube if the centring ring according to the invention is provided with preferably four radial pins arranged perpendicularly in relation to one another. So that the device can even out any dimensional deviations of the fireproof parts or other components, these radial pins can be moved freely within a pre-specified depth range of the tooth gaps.

Furthermore, the invention makes provision such that the teeth of the centring crown have a slanted tip around the circumference on both sides. In this way the radial pins of the centring ring can easily engage in the tooth gaps of the centring crown.

In order to facilitate the introduction of one centring part into the other provision is additionally made such that in devices the centring ring of which is mounted in the support ring, the teeth of the centring crown are slanted radially on the head side towards the tip of the teeth. Similarly, the invention also makes provision such that in devices the centring crown of which is mounted in the support ring, the centring ring is slanted radially towards the face edge.

In order to facilitate the pre-centring and centring, the support ring is provided with a gimbal mounting, one tilt axis of which is supported on the fork of a manipulator, and the other tilt axis of which is fastened to a mounting ring for the component of the centring device that is mounted to be freely rotatable within said mounting ring. It is advantageous here if the gimbal mounting has a tilt angle of preferably +/−5°.

Since the device according to the invention guarantees correct alignment of the casting tube, it is particularly suitable for tube mountings the casting tube of which is provided with a flat seal between the latter and the pouring sleeve.

BRIEF DESCRIPTION OF THE DRAWINGS

In the following the invention is described in more detail by means of two exemplary embodiments with reference to the drawings. These show as follows.

DETAILED DESCRIPTION OF THE INVENTION

Figure 1:
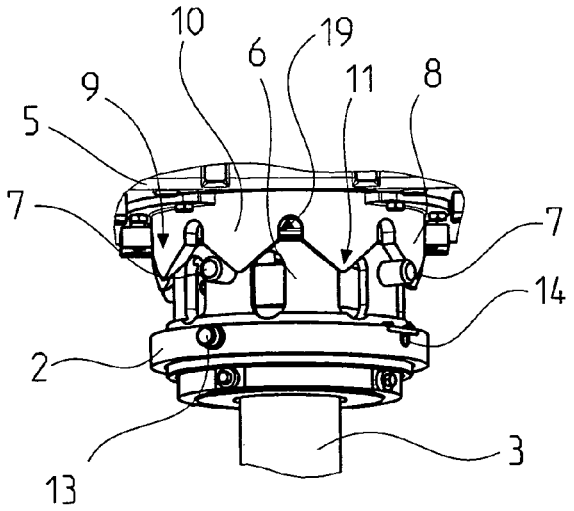
FIG. 1 is a first version of the casting tube mounting according to the invention, shown before the radial pins are engaged.

The casting tube mounting 1 shown in FIG. 1 to FIG. 5 has a support ring 2 with a casting tube 3 which rests tightly against the pouring sleeve 4 of a sliding closure 5 during operation. There is disposed in the support ring 2 a centring ring 6 with four radial pins 7 lying perpendicularly in relation to one another which interacts with a centring crown 8 fastened onto the sliding closure 5 coaxial to the pouring sleeve 4.

The centring crown 8 has a toothed ring 9 the relatively wide teeth 10 of which are provided with a tooth tip 11 slanted around the circumference on both sides. The teeth 10 are also radially slanted with an incline directed towards the tooth tip.

The support ring 2 is provided with a gimbal mounting, one tilt axis of which is formed by two diametrically arranged radial pins 13, while the other tilt axis is formed by two radial screws 14 likewise arranged diametrically, and which are screwed into a mounting ring 15 for the centring ring 6. This mounting can rotate freely in the mounting ring 15. The gimbal mounting 12 is configured here such that it enables a tilt angle of +/−5°.

During operation the radial pins 13 of the mounting 1 are supported on the fork 16 of a manipulator 17 with the aid of which the tube mounting 1 is pressed with the casting tube 3 against the pouring sleeve 4 of the sliding closure 5.

Figure 2:
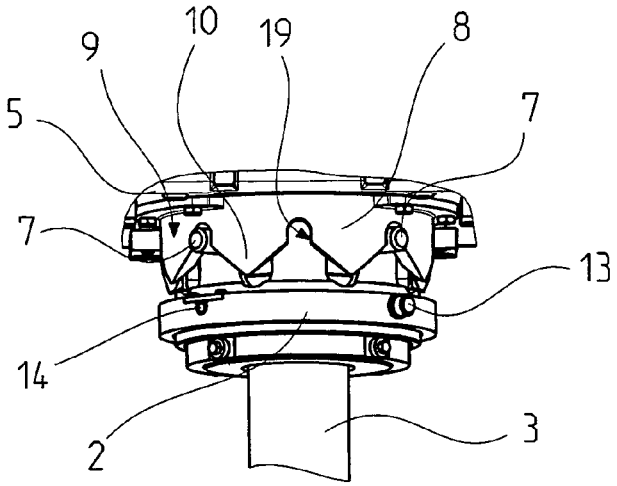
FIG. 2 is the version from FIG. 1, shown after the radial pins are engaged.
Figure 3:
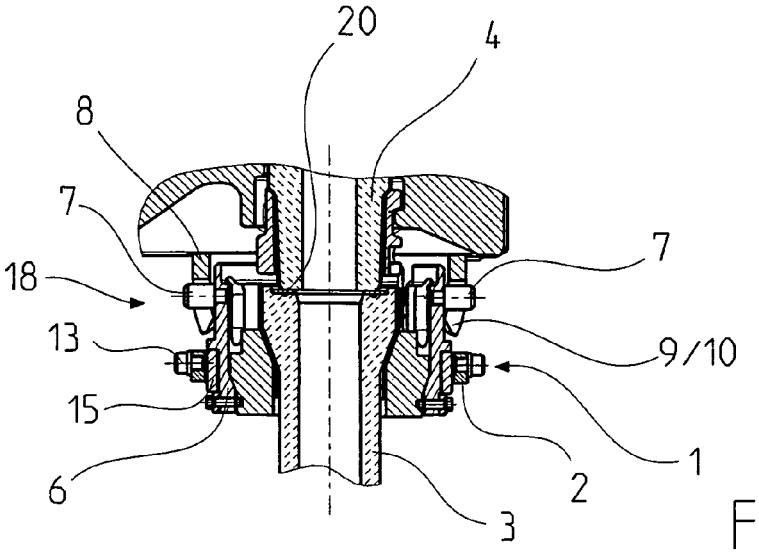
FIG. 3 is the version from FIGS. 1 and 2, shown in section and with the radial pins engaged.
Figure 4:
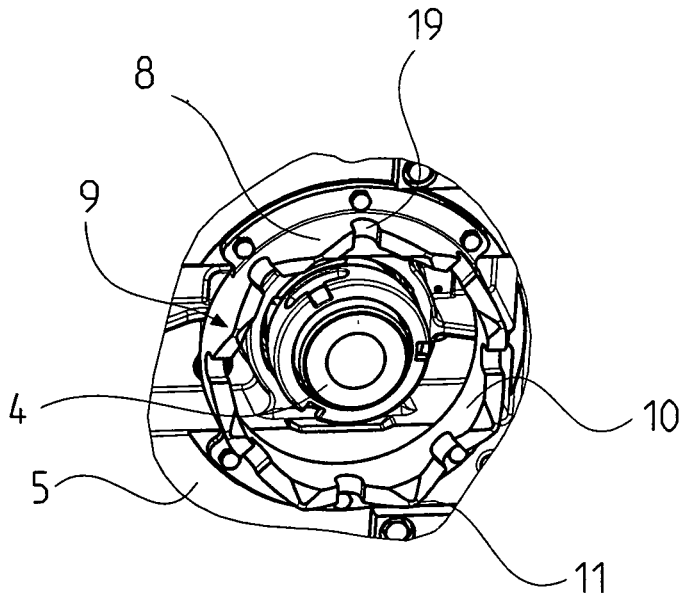
FIG. 4 is the centring crown of the version from FIGS. 1 to 3.
Figure 5:
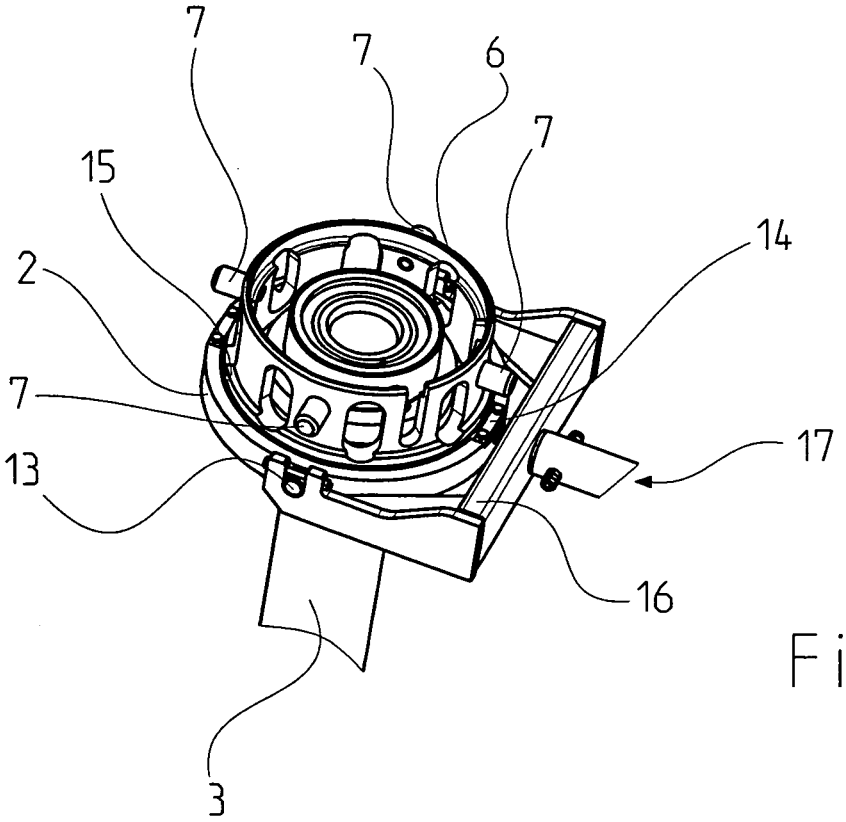
FIG. 5 is the support ring and the centring ring of the version from FIGS. 1 to 3, suspended on the fork of a manipulator.
Figure 6:
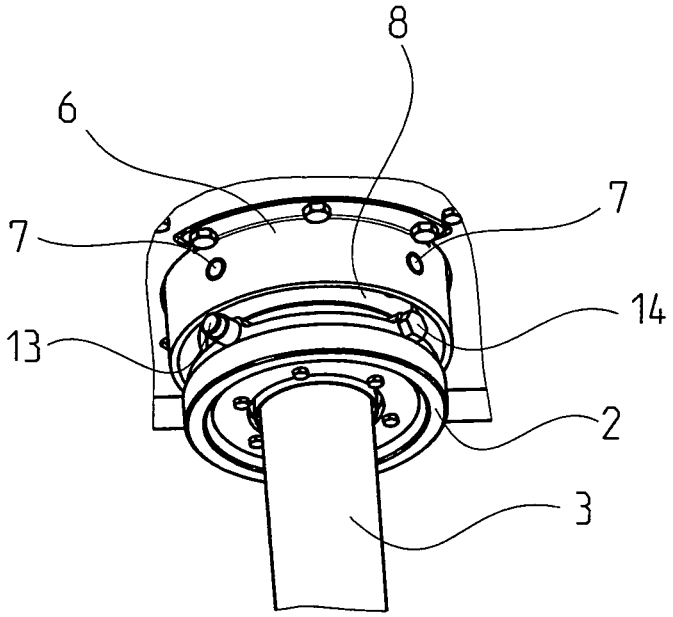
FIG. 6 is a second version of the casting tube mounting according to the invention, shown with the radial pins engaged.
Figure 7:
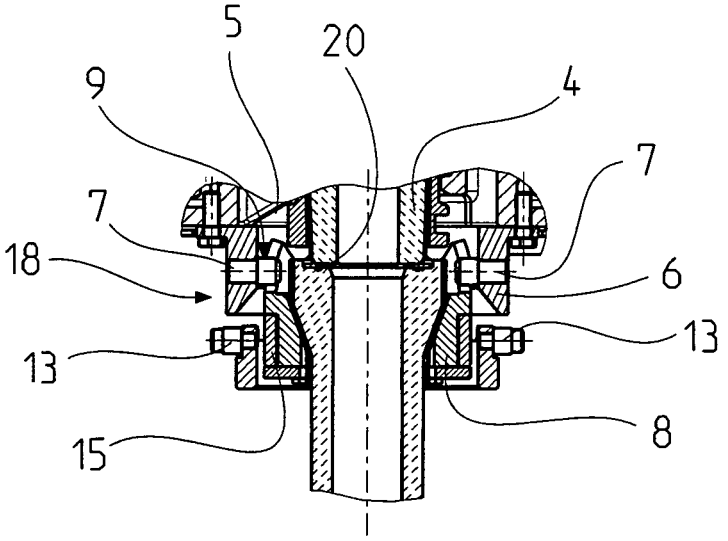
FIG. 7 is the version from FIG. 6, shown in section and with the radial pins engaged.
Figure 8:
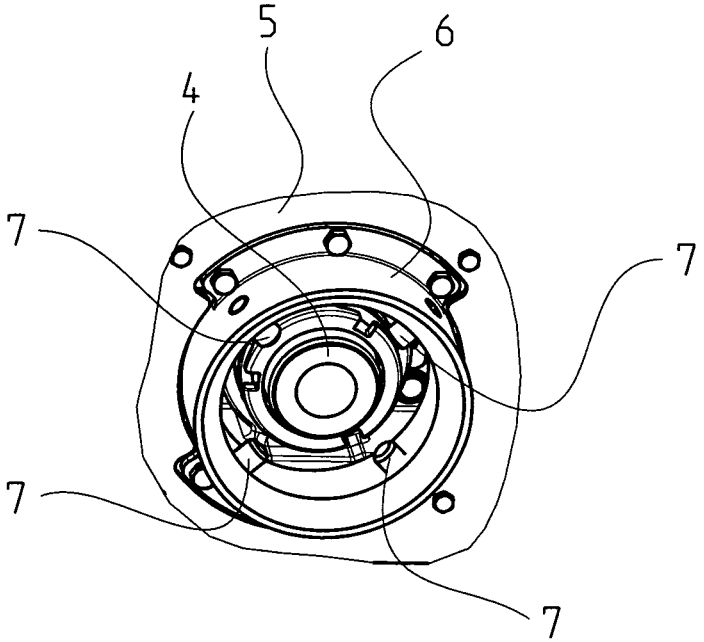
FIG. 8 is the centring ring of the version from FIGS. 6 and 7.
Figure 9:
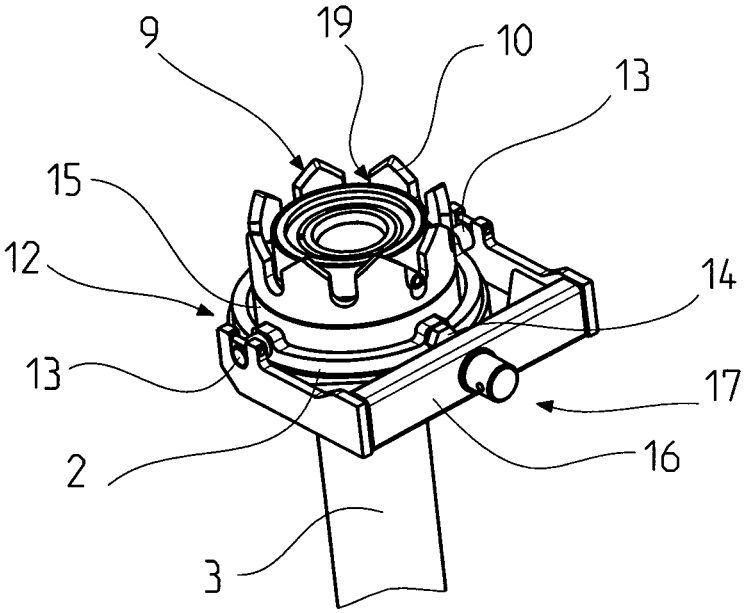
FIG. 9 is the support ring and the centring crown of the version from FIGS. 6 and 7, likewise suspended on the fork of a manipulator.

The centring ring 6 and the centring crown 8 form a centring device 18 for the casting tube which during operation positions it exactly centrically to the pouring sleeve 4 of the sliding closure. Centring is brought about in that by pressing on the casting pipe the radial pins 7 of the centring ring 6 can engage in the tooth gaps 19 of the centring crown 8. This process is illustrated by FIG. 1 and FIG. 2. FIG. 1 shows an intermediate position in which the centring ring 6 is already introduced into the inner region of the centring crown 8, by means of which pre-centring of the tube mounting 1 with the casting tube is brought about. The radial pins 7 are then pressed against the slanted tooth tips 11 and slide into the tooth gaps 19 of the toothed ring, at the same time the centring ring 6 being rotated in the mounting ring 15. In the final position according to FIG. 2 the four radial pins 7 are engaged in the tooth gaps 19. In this way the immovable centring and alignment of the casting tube 3 is established.

The introduction of the centring ring 6 into the interior of the centring crown 8 is facilitated by on the one hand the tube mounting 1 being tiltable by a specific tilt angle by the gimbal mounting 12 and on the other hand the tooth tips 11 of the teeth 10 being radially slanted.

In the exemplary embodiment described the centring ring 6 is equipped with four radial pins lying perpendicularly in relation to one another. However, it is easily possible within the framework of the invention to vary the number and arrangement of the radial pins 7 in so far as they guarantee consistently secure coupling of the centring ring 6 with the centring crown 8. It is likewise possible within the framework of the invention to design the gimbal mounting 12 with a tilt angle deviating by +/−5°.

The radial pins 7 can be moved freely within a specific depth range of the tooth gaps 19. The centring device can in this way compensate any dimensional deviations of the fireproof parts or other components.

The tube mounting according to FIG. 6 to FIG. 9 essentially differs from the version according to FIG. 1 to FIG. 5 in that in the latter the centring crown 8 is mounted in the support ring 2, while the centring ring 6 with the radial pins 7 is fastened onto the sliding closure 5. In order to facilitate the introduction of the centring crown into the centring ring, the latter is radially slanted on the face side. The mode of handling and operation is identical to the embodiment according to FIG. 1 to FIG. 5.

In the version according to FIG. 6 to FIG. 9 the centring crown 8 is almost totally covered by the centring ring 6 during operation. In this way it is better protected against external influences. For this purpose it is more easily accessible in the version according to FIG. 1 to FIG. 5 and the prospect with any problems that occur is better.

Since the device according to the invention guarantees correct alignment of the casting tube, it is an option particularly when there is used between the casting tube and the pouring sleeve, an appropriate flat seal 20 which stresses the well-aligned casting tube evenly.

The invention claimed is:

1. A casting tube mounting, comprising:

a support ring for supporting a casting tube, a centering device including first and second components that interact with one another, and a mounting ring that rotatably supports one of the first and second components on the support ring while the other of the first and second components is adapted to be fastened onto a sliding closure, the first component comprising a toothed centering crown including slanted tooth tips and tooth gaps between said tooth tips, the second component comprising a centering ring having radial pins the mounting ring being configured to enable relative rotational movement between the centering ring and the centering crown while the pins are pressed against the tooth tips to cause the pins to slide along the tooth tips and into the tooth gaps.

2. The casting tube mounting of claim 1, wherein the first component is adapted to be fastened onto the sliding closure and the second component is supported on the support ring by the mounting ring such that the mounting ring rotatably supports the centering ring on the support ring, whereby the centering ring is operatively pushed into the centering crown to cause the pins to be pressed against the tooth tips and rotatable to enable the pins to slide along the tooth tips into the tooth gaps.

3. The casting tube mounting of claim 1, wherein the centering crown is radially outward from the centering ring and the radial pins are directed radially outward from the centering ring.

4. The casting tube mounting of claim 1, wherein the first component is supported on the support ring by the mounting ring such that the mounting ring rotatably supports the centering crown on the support ring and the second component is adapted to be fastened onto the sliding closure, whereby the centering crown is operatively pushed into the centering ring to cause the pins to be pressed against the tooth tips and rotatable to enable the pins to slide along the tooth tips into the tooth gaps.

5. The casting tube mounting of claim 1, wherein the centering ring is radially outward from the centering crown and the radial pins are directed radially inward from the centering ring.

6. The casting tube mounting of claim 1, wherein the centering ring includes four radial pins arranged perpendicularly in relation to one another.

7. The casting tube mounting of claim 1, wherein the tooth gaps have a size relative to a size of the radial pins of the centering ring to enable the radial pins to move freely within the tooth gaps.

8. The casting tube mounting of claim 1, wherein the centering crown has a surface facing the second component, the tooth tips and tooth gaps being defined by the surface.

9. The casting tube mounting of claim 1, wherein teeth are defined by adjacent pairs of tooth tips around a circumference of the centering crown.

10. The casting tube mounting of claim 1, wherein the centering crown includes teeth, each of the teeth being defined by two adjacent ones of the tooth tips that have opposite directions of slant.

11. The casting tube mounting of claim 1, wherein teeth are defined by adjacent pairs of tooth tips, each of the teeth being slanted radially on an inward, head side toward a tip of the tooth.

12. The casting tube mounting of claim 1, wherein the centering ring is slanted radially on an outside towards a face edge of the centering ring.

13. The casting tube mounting of claim 1, further comprising:

a manipulator having a fork; and a gimbal mounting for the support ring, the gimbal mounting defining a first tilt axis about radial pins supported by the fork and a second tilt axis that enables pivotal movement of the mounting ring relative to the support ring.

14. The casting tube mounting of claim 13, wherein the gimbal mounting has a tilt angle of +/−5°.

15. The casting tube mounting of claim 1, further comprising a seal arranged against a face of the casting tube.

16. The casting tube mounting of claim 1, wherein said centering crown is annular and defines the tooth tips on a surface facing the centering ring and such that the tooth gaps open from the surface in a direction toward the centering ring.

17. The casting tube mounting of claim 1, wherein the mounting ring rotatably supports the centering ring on the support ring.

18. The casting tube mounting of claim 1, wherein the mounting ring rotatably supports the centering crown on the support ring.

19. The casting tube mounting of claim 1, further comprising a tilting unit for tilting the support ring to enable the radial pins to be brought into pressing contact with the tooth tips.

20. The casting tube mounting of claim 1, wherein the tooth tips are slanted toward the tooth gaps.

* * * * *